United States Patent [19]

Cawlfield et al.

[11] Patent Number: 5,064,514

[45] Date of Patent: Nov. 12, 1991

[54] APPARATUS FOR THE PRODUCTION OF CHLORIC ACID

[75] Inventors: David W. Cawlfield; Harry J. Loftis, both of Cleveland, Tenn.

[73] Assignee: Olin Corporation, Cheshire, Conn.

[21] Appl. No.: 502,099

[22] Filed: Mar. 30, 1990

[51] Int. Cl.[5] ..... C25B 1/22

[52] U.S. Cl. ..... 204/103; 204/262; 204/263; 204/282

[58] Field of Search ..... 204/103, 252, 262–263, 204/282–283, 274

[56] References Cited

U.S. PATENT DOCUMENTS

| | | | |
|---|---|---|---|
| 3,810,969 | 5/1974 | Schlumberger | 423/478 |
| 4,238,302 | 12/1980 | Lohrberg | 204/103 |
| 4,432,858 | 2/1984 | Schmitt et al. | 204/284 |
| 4,469,576 | 9/1984 | Akazawa et al. | 204/237 |
| 4,490,231 | 12/1984 | Boulton | 204/263 |
| 4,495,045 | 1/1985 | Murakami et al. | 204/274 |
| 4,734,181 | 3/1988 | Cipriano | 204/263 |
| 4,740,287 | 4/1988 | Cawlfield | 204/256 |
| 4,743,350 | 5/1988 | Cawlfield et al. | 204/255 |
| 4,770,756 | 9/1988 | Cawlfield et al. | 204/263 |

*Primary Examiner*—John F. Niebling
*Assistant Examiner*—Kathryn Gorgos
*Attorney, Agent, or Firm*—Ralph D'Alessandro

[57] ABSTRACT

An electrolytic filter press membrane cell and a method of operating the cell are disclosed to produce concentrated chloric acid. The cell employs concentrated hypochlorous acid as the anolyte and operates at high current density. The anode structure employs a high surface area to volume ratio structure that is thin and minimizes anolyte residence time in the cell.

12 Claims, 3 Drawing Sheets

APPARATUS FOR THE PRODUCTION OF CHLORIC ACID

BACKGROUND OF THE INVENTION

This invention relates to the production of chloric acid, $HOCl_3$, from hypochlorous acid. More specifically it relates to the filter press membrane cell apparatus utilized to electrolytically produce chloric acid in high current density operation. Chloric acid can be used in the formation of chlorine dioxide, a commercial bleaching and sanitizing agent.

Chloric acid is a known compound which has been made in laboratory preparations by the reaction of barium chlorate with sulfuric acid to precipitate barium sulfate and produce a dilute aqueous solution of chloric acid which was concentrated by evaporation of water under partial vacuum. In another methods sodium chlorate is reacted with an acid such as hydrochloric acid or sulfuric acid to produce an aqueous solution of chloric acid containing sulfate or chloride ions as impurities. In addition, commercial processes for producing chlorine dioxide form chloric acid as an intermediate.

U.S. Pat. No. 3,810,969 issued May 14, 1974 to A. A. Schlumberger teaches a process for producing chloric acid of high purity by passing an aqueous solution containing from 0.2 gram mole to 11 gram moles per liter of an alkali metal chlorate such as sodium chlorate through a selected cationic exchange resin at a temperature from 5° to 40° C. The process mole to about 4.0 gram moles of $HOCl_3$.

Until the present time chloric acid, however, has not been produced or available commercially because of high manufacturing costs and because of concomitant undesired impurities formed with the chloric acid during its production. A way to efficiently produce chloric acid at substantially reduced costs has been discovered that appears to be commercially feasible. Prior chloric acid production routes have yielded impurities, such as alkali metal ions, chloride ions and sulfate ions. These problems are solved in the design of the present invention by providing a filter press membrane electrolytic cell that operates at high current density to produce concentrated high purity chloric acid that is stable at ambient conditions.

SUMMARY OF THE INVENTION

It is an object of the present invention to provide an electrolyzer to produce chloric acid from hypochlorous acid.

It is another object of the present invention to provide an electrolyzer in the form of a filter press membrane cell that uses concentrated hypochlorous acid as the anolyte fluid.

It is a feature of the present invention that the electrolytic cell is designed to operated at high current density.

It is another feature of the present invention that the total interelectrode gap or the distance between the anode, the membrane, and the cathode is minimized.

It is a further feature of the present invention that the anode structure provides a high surface area to volume ratio and permits high mass transfer to be accomplished while the anode structure is thin to minimize anolyte residence time.

It is yet another feature of the present invention that the cathode is supported on a metallic plate to promote current distribution across the cathode surface.

It is another feature of the present invention that the membrane surface is pressed against the surface of the cathode in the assembled electrolytic cell.

It is still another feature of the present invention that there is a small gap between the anode and the membrane surface to permit the anolyte to contact all of the electroactive surfaces of the anode.

It is still a further feature of the present invention that anolyte fluid is continuously recirculated through the cell so that freshly supplied hypochlorous acid is mixed rapidly with the recycled anolyte.

It is yet another feature of the present invention that the catholyte fluid is not force circulated through the electrolytic cell.

It is another feature of the present invention that an anolyte disengager is employed to separate the oxygen and chlorine gas produced at the anode from the circulating anolyte fluid.

It is another advantage of the present invention that the electrolytic cell is able to operate with minimum electrical resistance at high current densities.

It is another advantage of the present invention that hydrogen produced in the cathode does not interfere with the ionic transport of hydrogen ions through the membrane to the cathode by having the cathode pressed against the membrane surface.

These and other objects, features and advantages are provided in the high current density filter press membrane electrolytic cell of the present invention to produce chloric acid from a hypochlorous acid anolyte by providing improved and uniform anolyte fluid flow distribution.

BRIEF DESCRIPTION OF THE DRAWINGS

The objects, features and advantages of the invention will become apparent upon consideration of the following detailed disclosure of the invention, especially when taken in conjunction with the accompanying drawings wherein.

DETAILED DESCRIPTION OF THE PREFERRED EMBODIMENT

Figure 2:
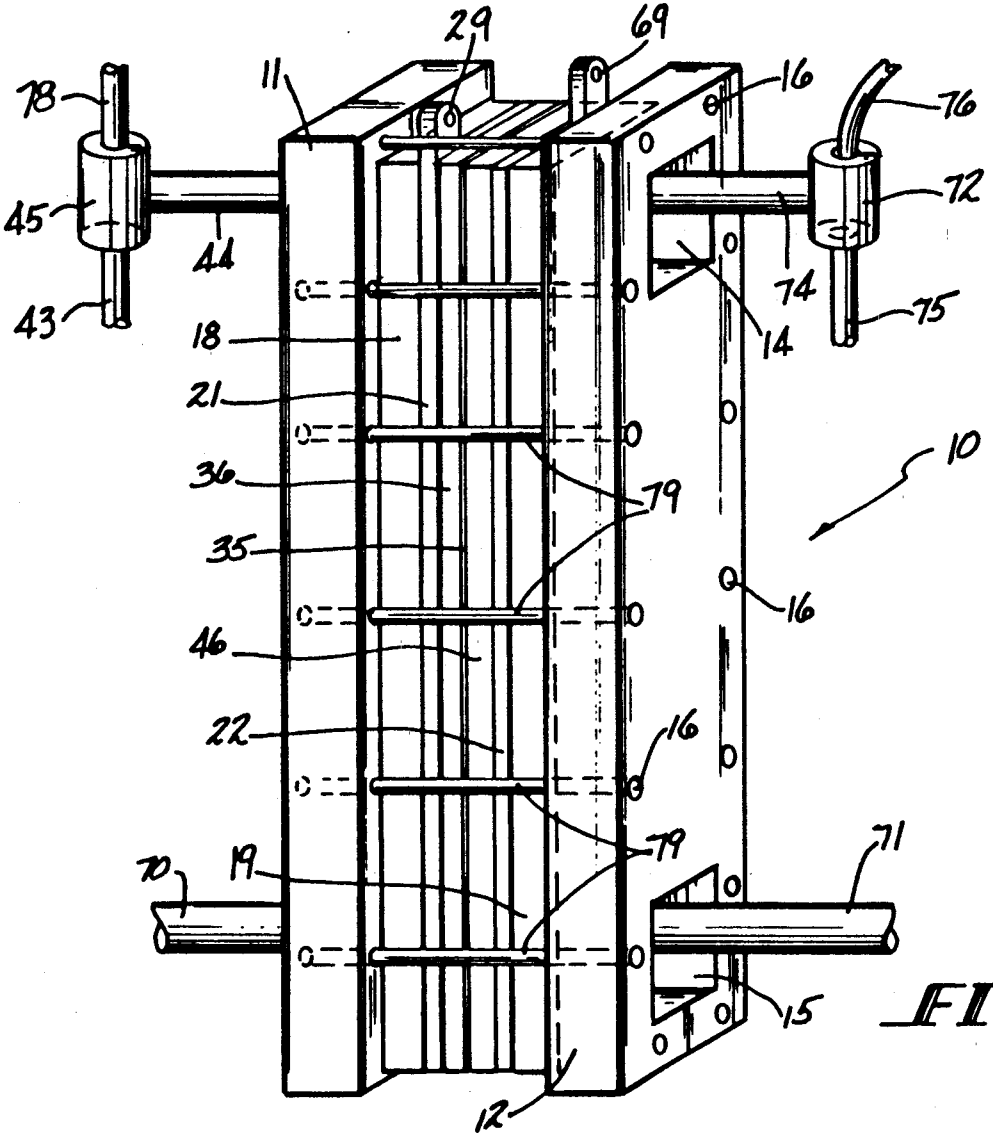
FIG. 2 is a perspective view of the assembled electrolyzer of FIG. 1 showing the anolyte and catholyte disengagers and the anolyte and catholyte feed lines.

An assembled electrolyzer, indicated generally by the numeral 10, as shown in FIG. 2 that is used to produce a chloric acid solution by a process that electrolyzes an aqueous solution of hypochlorous acid at a temperature of from about 1° to about 40° C. according to the equation:

$$HOCl + 2H_2O \rightarrow > HOCl_3 + 2H2 + 4e$$

The novel process employed in the novel electrolyzer of the present invention uses a concentrated solution of hypochlorous acid, HOCl, as the starting material. A satisfactory method of producing high purity concentrated HOCl solutions is by the process described by J. P. Brennan et al in U.S. Pat. No. 4,147,761, which is specifically incorporated by reference hereafter in its entirety. This process produces gaseous mixtures that have high concentrations of hypochlorous acid vapors, chlorine monoxide gas, and controlled amounts of water vapor. This gaseous mixture is then converted to a concentrated hypochlorous acid solution.

The electrolyzer 10 employs a hypochlorous acid solution as the anolyte that preferably contains concentrations up to about 0.5 to about 60, and more preferably from about 2.0 to about 35 percent by weight of HOCl. The solution is substantially free of ionic impurities, such as chloride ions and alkali metal ions, as well as metal ions, such as nickel and copper. A representative concentration of the chloride ion in the anolyte is less than about 50 parts per million and a representative concentration of, an alkali metal ion concentration of less than about 50 parts per million.

The electrochemical process occurs in the electrolyzer or cell 10 of the present invention by using a high conversion rate of HOCl in the cell 10 to reduce the requirements for recycling or purifying residual HOCl. Optimum cell efficiency is obtained at a chloric acid concentration of less than about 35 percent by weight.

Figure 1:
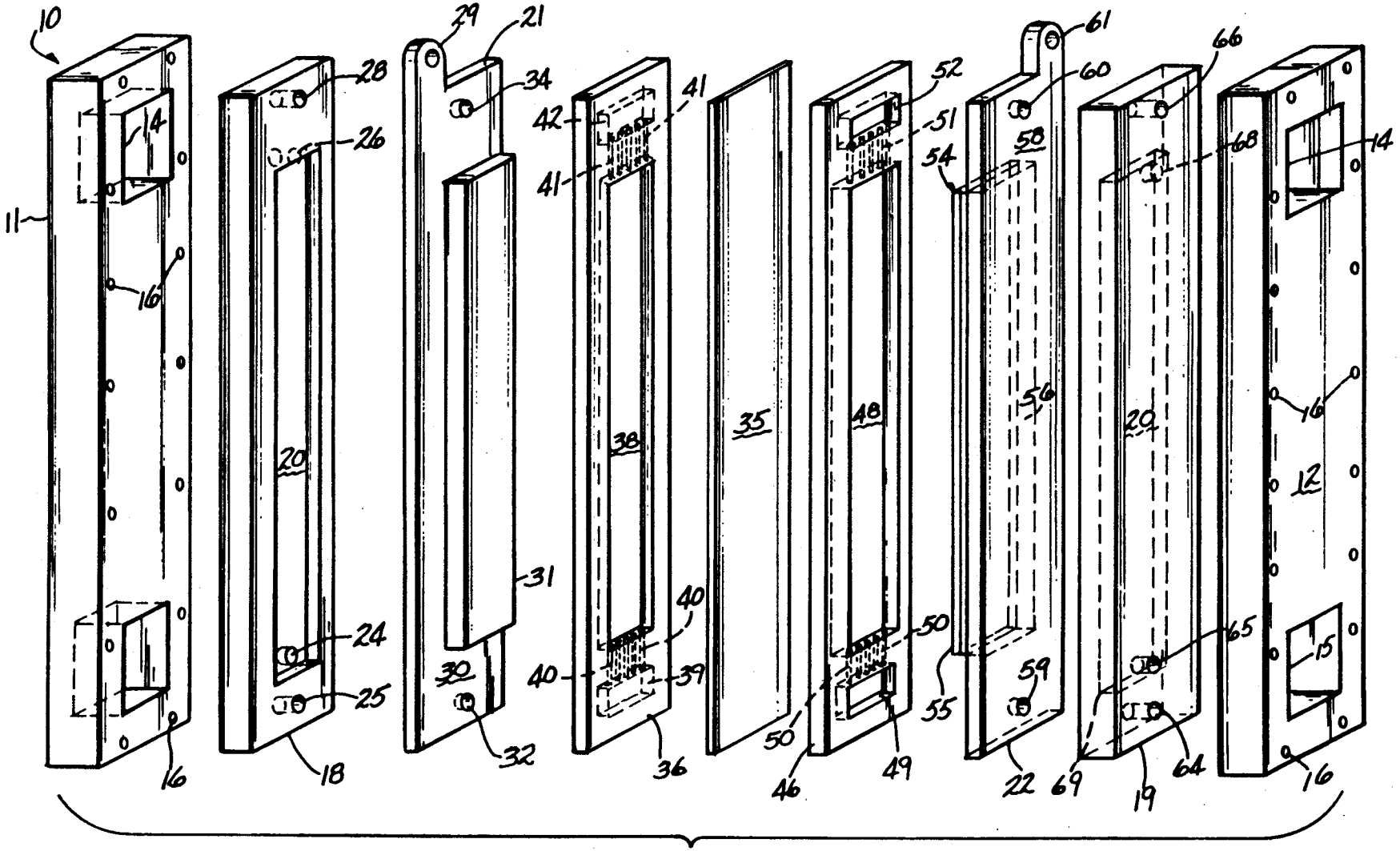
FIG. 1 is an exploded perspective view of the electrolyzer that has a single anode and a single cathode separated by an ion selectively permeable membrane.

The electrolyzer or cell 10 is shown in exploded fashion in FIG. 1 as comprising on its opposing ends an anode backplate 11 and a cathode backplate 12. Anode backplate 11 and cathode backplate 12 are identical in construction and are formed from preferably carbon steel that is degreased and are grit or sand blasted. Backplate through passages 14 and 15 are used to permit the anolyte and catholyte infeed pipes and the anolyte and catholyte product outlet pipes to connect into the cell, as can be seen briefly in FIG. 2. A plurality of bolt retaining holes 16 extend about and through the periphery of the backplates 11 and 12 to permit the cell to be assembled and compressed together in a liquid-type fashion by the tightening of the bolts 79 of FIG. 2.

Figures 3, 4, 5, 6, 7, 8:
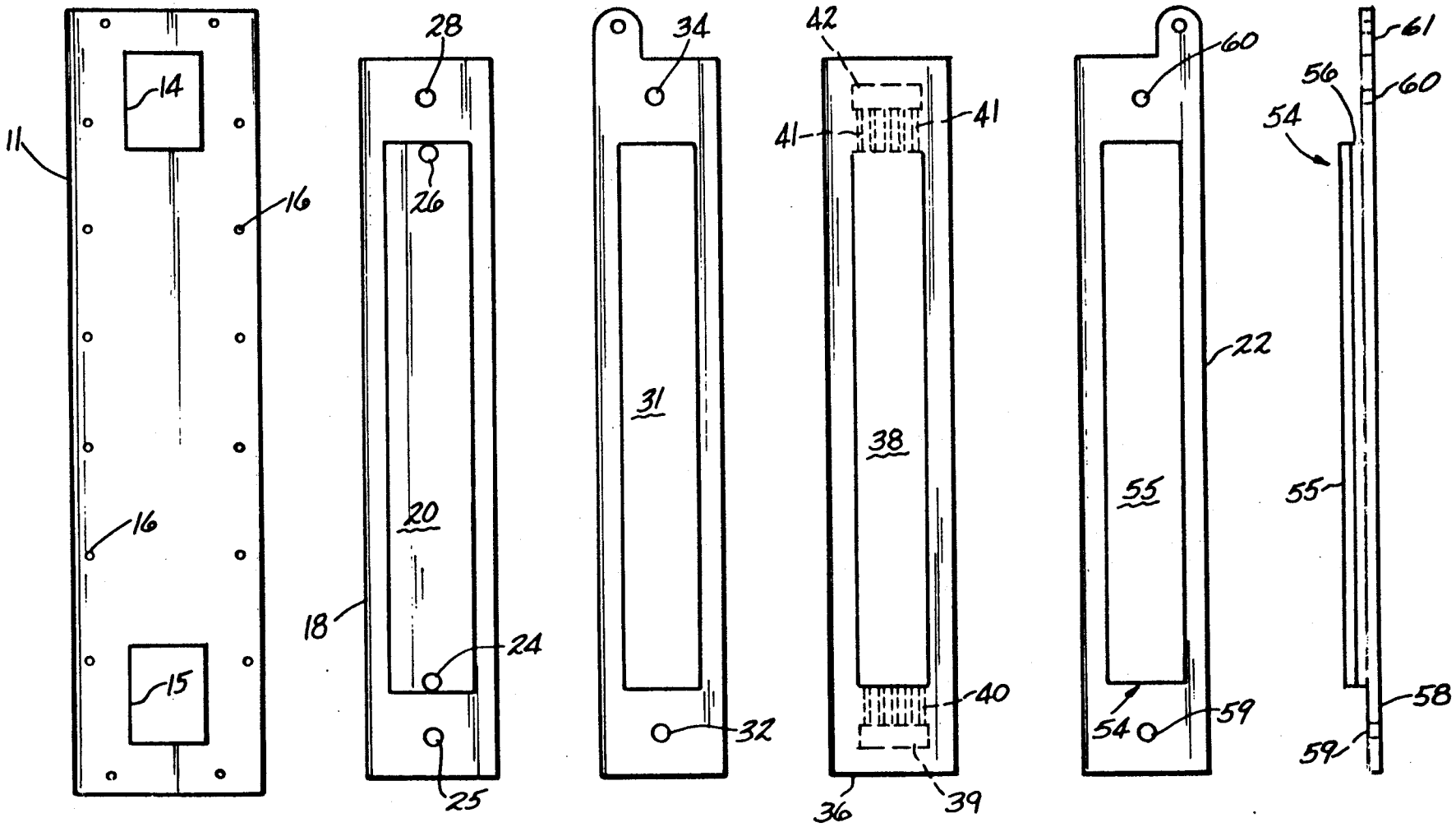
FIG. 3 is a top plan view of the electrolyzer backplate that is used for both the anode and the cathode.
FIG. 4 is a top plan view of the anode cooling plate.
FIG. 5 is a top plan view of the anode.
FIG. 6 is a top plan view of the anode spacer.
FIG. 7 is a top plan view of the cathode.
FIG. 8 is a side elevational view of the cathode.

Adjacent the anode and cathode backplates 11 and 12, respectively, are cell cooling plates 18 and 19. Plates 18 and 19 have a hollowed out or grooved area 20 that is open on the side adjacent the anode 21 and the cathode 22 but is closed and solid at the surface of the cooling plate on the side adjacent the backplates 11 and 12. This hollowed out or grooved area 20 (see FIG. 4D) will permit the circulation of a coolant to control the heat of the electrolyzer, if necessary. Suitable coolants can include solutions of alcohol or glycol. This may be especially necessary on the anode side to prevent potential thermal decomposition of the hypochlorous acid. As seen in FIGS. 1 and 4, the anode cell cooling plate 18 is designed with a coolant infeed connection 24 and an anolyte infeed connection 25 on its bottom. Near the top, a corresponding coolant outlet connection 26 and an anolyte product outlet connection 28 are provided. The anode cell cooling plate 18 and the cathode cell cooling plate 19 are preferably constructed from a heat and chlorine resistant material, such as polytetrafluoroethylene such as that sold under the tradename TEFLON®.

The anode 21 is positioned adjacent the anode cooling plate and has a conductive tab 29 at its top to connect to the source of electrical energy to drive the anodic electrolytic reaction. The anode consists of a plate 30, preferably about 0.04 inches thick, to which is suitably fastened a raised mesh or felt portion 31 of the active anode material. An anolyte infeed connection 32, corresponding to the anolyte infeed connection 25 in the anode cell cooling plate 18, is found at the bottom and extends through plate 30. A corresponding anolyte outlet connection 34 is found at the top of plate 30 and corresponds to the anolyte outlet connection 28 in the anode cell cooling plate 18.

The anode structure may utilize titanium in the anode plate 30, or platinum. The active anode surface material 31 can be comprised of any porous high surface area material that has a high oxygen overvoltage, that is stable, and is strongly acidic in oxidizing environment. Suitable materials that can be employed in the anode structure include platinum and platinum group metals, metal substrates coated with platinum or platinum group metals, lead dioxide and metal substrates coated with lead dioxide and titanium-niobium alloy fibers. Suitable substrates include the valve metals, such as titanium and niobium. The anode 18 has been made by employing a platinum clad niobium plate 30 to which the active anode surface area material 31 has been spot welded in an inert atmosphere. A titanium felt metal structure, for example, was made by randomly laying titanium fibers on the plate 30 and spot welding them under a helium blanket with an electrical resistance welder. This technique prevents the oxidation of the titanium and allows the titanium to be joined, rather than merely oxidizing and forming non-conductive and non-fusible oxides. A platinum coating may be used on the titanium to form a platinum clad mesh electrode. Titanium-niobium alloy fibers may also be used.

Adjacent the anode 21 and separating the anode 21 from the membrane 35 is an anode spacer 36. Spacer 36 has a hollowed out cavity 38 which is about ⅛ inch deeper than the active anode surface area material 31 to form an anode chamber that leaves a small gap between the membrane 35 and the active anode surface area material 31 through which the anolyte is circulated in flow parallel to the membrane 35 and through the material of the active anode surface area material 31. Spacer 36 has a flow receptacle 39 that is opened on only the side away from the membrane to receive the inlet flow of anolyte fluid through the connections 25 and 32. The infeed anolyte flows from the receptacle 39 upwardly through inlet passages 40 to the cavity 38 where it comes into contact with the active anode surface area material 31 where it is electrolyzed. The product chloric acid, any gas, such as oxygen, and the unreacted anolyte exit the cavity 38 through outlet flow passages 41 and flow into the upper receptacle 42. From there the product passes out through the anolyte outlet connections 28 and 34 to enter the anolyte outlet conduit 44 of FIG. 2 for separation in the disengager 45.

The membrane 35 seen in FIG. 1 is a cation selectively permeable exchange membrane that is used as a separator between the anode and cathode compartments. The membrane 35 is inert and substantially impervious to the hydrodynamic flow of electrolytes and the passage therethrough of substantially all of the gas products produced in the anode or cathode compartments. The membrane 35 will permit some hydrogen ions to migrate through the membrane as $H_3O^+$ to pull water through the membrane in a desired membrane water transport mechanism. However, it is desired that the membrane should have the characteristics which minimize membrane chlorine transport as well as preventing chloride ion back-migration that can lead to chlorine evolution in the anolyte. The typical eluorocarbon-based, cation permeable membranes commercially available are highly efficient and exclude chloride ion transport.

Cation exchange membranes are well-known to contain fixed anionic groups that permit intrusion and exchange of cations, and exclude anions from an external source. Generally the resinous membrane or diaphragm has as a matrix, a cross-linked polymer, to which are attached charged radicals such as $-SO_3$ and/or mixtures thereof with $-COOH^-$. The resins which can be used to produce the membranes include, for example, fluorocarbons, vinyl compounds, polyolefins, hydrocarbons, and copolymers thereof. Preferred are cation exchange membranes such as those comprised of fluorocarbon polymers having a plurality of pendant sulfonic acid groups or mixtures of sulfonic acid groups and phosphonic acid groups. The terms "sulfonic acid group" and "phosphonic acid groups" are meant to include derivatives of sulfonic acid, such as sulfonyl fluoride or sulfonyl chloride which may be converted to sulfonic acid groups by processes such as hydrolysis, or derivatives of phosphonic acid groups which may similarly be converted to phosphonic acid groups by processes such as hydrolysis.

Suitable membranes employed have been that sold by the E. I. DuPont de Nemours Company under the tradename NAFION® 117 and perfluoronated sulfonic acid membranes available by the assignee of U.S. Pat. No. 4,470,888.

Continuing with the description of the exploded view in FIG. 1, a cathode spacer 46 is provided adjacent the membrane 35 and is identical in construction to the anode spacer 36. The hollowed out cavity 48 receives the active area of the cathode in the same way as the anode spacer 36 utilized its hollowed cavity 38. A lower receptacle 49 receives the inlet flow of catholyte but is closed on the side facing the membrane 35. The catholyte flows from the cathode spacer lower receptacle 49 through catholyte inlet passages 50 to the hollowed out cavity 48 where the catholyte flows parallel to the cathode active surface material 54 of the cathode 22. The catholyte is removed from the cathode compartment by the rising action of the hydrogen gas generated on the active cathode surface 54 by passing through the catholyte outlet passages 51 in the cathode spacer 46 and entering the cathode spacer upper receptacle 52.

The cathode 22 as seen in FIGS. 1, 7 and 8 comprises a cathode active surface area 54 and a backplate 58 to which the active surface material is suitably fastened, such as by welding. The catholyte enters and leaves the cathode spacer 46 in the cathode 22 in a manner similar to that by which the anolyte flows through the anolyte side of the cell 10, except that deionized water can be used in one preferred mode of operation as the sole liquid to initially fill the catholyte chamber and thereafter need not be added. The cathode backplate 58 which is formed of the suitably resistant stainless steel, such as a Hastelloy ®C material, has a catholyte inlet connection 59 on the bottom and a catholyte outlet connection 60 and on the top. An electrical connection to the source of electrical power is present as tab 61 connecting to the top of the backplate 58 to provide the electrical energy to drive the cathodic electrolytic reaction.

Connected to the backplate 58 are two layers of active cathode material 54. The first is a very fine layer that is smooth and in direct contact with the membrane 35 when the cell is assembled. This is a fine 100 mesh material which is laid on top and spot welded to a course second mesh layer 56 that can be from a 6 to a 10 mesh material that allows gas and liquid to pass there through in the X and Y axial directions.

The cathode active surface 54 is in contact with the membrane 35 in the assembled cell to minimize the interference of hydrogen gas produced on the cathode with the ionic conduction of hydrogen ions through the membrane to the cathode. A number of suitable materials that evolve hydrogen gas may be employed in the cathode, such as stainless steel, platinum, and platinum or platinum group metal plated substrates. The cathode in the instant cell 10 serves the purpose of converting hydrogen ions to hydrogen gas using the minimum amount of electrical energy. The design of the cathode 22 permits operation of the electrolyzer 10 without having a forced catholyte circulation loop. The catholyte may be any suitably dilute acid such as a mineral acid, or is preferably initially deionized water that is converted to a dilute hydrochloric acid of about 3 to about 5 percent concentration from reduced HOCl and possibly chlorine gas. The HOCl and/or chlorine enters the cathode compartment by transport through the membrane. The hydrogen generated on the active cathode surface 54 moves through the cathode 22 and carries off excess catholyte. The zero-gap configuration of the active surface 54 of the cathode against the membrane 35 minimizes the electrical resistance or IR drop that occurs in the cell.

Varying the pressure on the anolyte side can control the quantity of water that passes through the membrane. Typically the pressure drop from the anolyte side to the catholyte side is from about 1 to about 40 pounds per square inch (psi). A pressure drop of 1 psi is sufficient to maintain a concentration of about a 3% to about a 5% HCl in the catholyte. A pressure drop of about 40 psi will increase the amount of water that passes through the membrane to dilute the catholyte to about 1% HCl concentration. Alternately, a greater pressure on the catholyte side by back pressure on the hydrogen gas forces back migration of water through the membrane. No acid passes through the membrane because the membrane selectively precludes the passage therethrough of any chloride ions. The back migration of water through the membrane results in the HCl being concentrated to about 30%.

Returning again to the description of the exploded view of the electrolyzer 10 in FIG. 1, it is seen that a cathode cooling plate 19 may be employed adjacent the cathode 22 and between the cathode backplate 12. Cathode cooling plate 19 has a catholyte infeed connection 64 and a catholyte cooling connection 65 near the bottom of the plate 19. A catholyte outlet connection 66 and a catholyte building outlet connection 68 are employed adjacent the top of the plate 19. A hollowed out area 69 in the catholyte cooling plate 19 is provided for the circulation of appropriate coolant in between the cooling inlet feed 65 and the cooling outlet feed 68.

As best seen in FIG. 2, the assembled electrolyzer 10 has an anolyte infeed conduit 70 and a catholyte infeed conduit 71 that pass through the anode backplate 11 and cathode backplate 12 bottom through passages 15 to connect with their respective anolyte and catholyte infeed connections. Similarly, an anolyte outlet conduit 44 and a catholyte outlet conduit 74 connect to the anolyte and catholyte outlet connections through the anode backplate 11 and the cathode backplate 12 through passages 14. The catholyte outlet conduit 74 connects to a catholyte disengager 72 which separates the liquid and the gas and recycles or removes for collection the liquid catholyte through a recirculation loop 75, while the catholyte gas exits a gas outlet pipe 76 that exits through the top of the disengager 72. Similarly, the anolyte disengager has an anolyte recirculation loop 43 that exits through the bottom for the recirculated anolyte or hypochlorous acid while the anolyte gas outlet pipe 78 exits the top of the anolyte disengager 45.

It is to be understood that the elements shown in FIG. 1, except for the backplates 11 and 12 and the cooling plates 18 and 19, are separated and sealed by an appropriate gasketing material (not shown) positioned therebetween to ensure fluid tightness. Suitable elastomeric gasketing material includes peroxide cured EPDM or expanded microporous polytetrafluorethylene sold under the tradename TEFLON® by the aforementioned E. I. DuPont de Nemours & Company.

In order to exemplify the results achieved using the novel electrolyzer of the present invention, the following examples are provided without any intent to limit the scope of the instant invention to the discussion therein. All parts and percentages are by weight unless otherwise indicated.

EXAMPLE 1

An electrochemical cell of the type shown in FIGS. 1 and 2 was employed having an anode chamber and a cathode chamber separated by a cation exchange membrane. The anode was formed from a platinum-clad niobium Plate about 0.04" thick having an active surface area formed of a 10×10 square weave mesh. The anode was spot-welded under an inert helium blanket to a platinum-clad niobium plate and placed within an anode spacer to form the anode chamber. The anode chamber with the spacer was about ⅛ inch (0.3176 centimeters) wider than the anode, leaving a small gap adjacent the cation exchange membrane through which the anolyte was force circulated. The cathode was formed from a two layer Hastelloy ®C-22 mesh structure having a very fine outer 100 mesh screen layer supported on a coarse inner (6 wires per inch) mesh layer. The cathode was attached to a solid Hastelloy ®C-22 backplate by spot welding and was placed within an anode spacer to form a cathode chamber. The cathode was in direct contact with the adjacent membrane in a zero-gap configuration. A cation permeable fluoropolymer based membrane, sold under the tradename Nafion ®117 by the E. I. duPont de Nemours & Company, separated the anode chamber from the cathode chamber. During cell operation, an aqueous solution of hypochlorous acid containing 25% by weight of HOCl was continuously fed to the anode chamber as the anolyte at a flow rate of about 0.5 ml/min.

The catholyte chamber was initially filled with deionized water. The deionized water was gradually acidified to a dilute hydrochloric acid of about 3% to about 5% concentration from the diffusion of a small amount of hypochlorous acid and/or chlorine gas from the anolyte chamber through the membrane. Since some water is also transported through the membrane with $H^+$ ions from the anolyte chamber to the catholyte chamber, excess catholyte is generated that was removed from the catholyte chamber by the rising action of the hydrogen and small amount of chlorine gas exiting out the top of the cathode into a catholyte gas-liquid disengager. The water transporting through the membrane obviates the need for adding further deionized water to the catholyte chamber after the initial fill.

After the initial startup, the cell was operated at a current of 7.5 amps which was gradually increased to a final current of 10 amps. The cell voltage was in the range of from 2.975 to 3.340 volts. Under these operating conditions, the concentration of chloric acid in the catholyte increased to 22.691% by weight of $HClO_3$ and the HOCl concentration decreased to 0.799% by weight. Gases produced in the anolyte chamber were scrubbed in an aqueous solution of 10% potassium iodide. The cell was operated for about twenty hours.

EXAMPLE 2

The electrolytic cell of Example 1 had the anode replaced with an anode formed from a platinum clad niobium plate with platinum clad mesh of the same size as in Example 1, but with a lead oxide coating. The cell was operated for about eleven and one-half hours by continuously feeding as the anolyte an aqueous solution of hypochlorous acid containing 15% by weight of HOCl. The cell operation was interrupted after about five and one-half hours and then restarted after about a sixteen and one-half hour interruption. The anolyte feed rate was maintained at 0.77–0.78 ml/min during the periods of operation. Employing currents in the range of from 5.0 to 7.5 amps, the cell voltage was in the range of 2.801 to 3.022 volts.

Chloric acid concentrations produced in the anolyte were in the range of from 8.812 to 10.406% by weight, with the concentration of HOCl being in the range of from 1.965 to 3.242% by weight after the first three hours of operation.

EXAMPLE 3

The electrolytic cell of Example 2 was employed with the same platinum cladding layer on the anode coated with lead oxide. The anolyte solution, an aqueous solution of hypochlorous acid containing about 15% by weight of HOCl, was continuously fed to the anode chamber at a rate maintained at about 0.77–0.78 ml/min. After startup, the cell current was maintained in the range of about 6.0 to about 7.1 amps and the cell voltage varied from about 2.685 to about 2.789 volts. The cell was operated for about 4 hours before operation was interrupted for about 17 hours and then resumed for an additional 4½ hours.

Chloric acid concentrations produced in the anolyte were in the range of from about 5.961 to about 8.376% by weight, with the concentration of HOCl being in the range of from about 5.635 to about 8.211% by weight after the first three hours of operation.

EXAMPLE 4

The electrolytic cell of Example 1 was employed, except that the anode was formed from a porous felt metal structure of titanium metal ribbons coated with platinum metal. After startup, the cell current was maintained at about 7.0 amps and cell voltages varied from about 2.750 to about 2.792 volts during about 7 hours of continuous operation.

Chloric acid was produced at a concentration in the range of from about 9.596 to about 11.547% by weight with the hypochlorous acid concentration being maintained at about 2.747 to about 3.014% by weight. The yield of chloric acid was in the range of about 38.9 to about 48% at HOCl conversions of from about 81.1 to about 85.0%. Current efficiencies were in the range of from about 62.1 to about 74.1%.

EXAMPLE 5

The electrolytic cell of Example 4 was operated for about 13 hours with one approximately 16 hour interruption after the first 6½ hours of operation using an aqueous solution of hypochlorous acid containing about 20% by weight of HOCl as the anolyte. After startup, the cell current was maintained in the range of about 7.0 to about 8.2 amps and cell voltages varied from about 2.662 to about 2.831. The yield of chloric acid having concentrations in the range of about 12.373 to about 17.208% by weight was from about 36.8 to about 47.2 percent. HOCl conversions of to $HClO_3$ ranged from about 71.2 to about 90.3%. Current efficiencies of about 62.1 to about 74.1% were achieved.

The concentrations of chloric acid produced were in the range of from about 12.275 to about 17.208% by weight at yields of about 28.2 to about 47.2% at conversions of about 95.3 to about 100%.

While the preferred structure in which the principles of the Present invention have been incorporated is shown and described above, it is to be understood that the invention is not to be limited to the particular details thus presented, but, in fact, widely different means may be employed in the practice of the broader aspects of this invention.

For example, where sulfuric acid is employed as the catholyte liquid, a concentration of from about 15% to about 50% may be continuously circulated through the cathode compartment by forced circulation. Such a cell will employ a membrane that does not touch the anode or the cathode. The chloric acid produced will be more concentrated because of the increased water transport through the membrane, resulting in a net concentration of the anolyte and a dilution of the sulfuric acid in the catholyte. The anode and the cathode in this cell will be flat plates of niobium clad platinum.

The scope of the appended claims is intended to encompass all obvious changes in the details, materials, and arrangement of parts that will occur to one of ordinary skill in the art upon a reading of the disclosure.

What is claimed is:

1. A filter press membrane cell having an anode and a cathode separated by a single cation selectively permeable membrane, the cell being retained by an anode backplate and an opposing cathode backplate wherein the improvement comprises:

(a) an anode having a conductive solid plate portion and a porous high surface area active anode surface area material portion, the porous portion projecting toward the membrane from and overlying the solid plate portion to permit the flow of anolyte fluid through said porous portion in a direction parallel to the membrane;

(b) spacer means adjacent the anode and fitting about the porous portion effective to space the porous portion from the membrane and permit anolyte fluid to flow between the membrane and the active anode surface area material; and (c) a cooling plate defining a cooling chamber intermediate the anode backplate and the anode to control the temperature of the anode during operation, the anode plate defining a wall separating a chamber containing the anode from the cooling chamber.

2. The apparatus according to claim 1 wherein the spacer means further has a hollowed central cavity into which the anode active surface area material fits.

3. The apparatus according to claim 1 wherein the spacer means further has receptacle means above and below the hollowed out central cavity, the receptacle means being grooved out of a frame and being open-topped on a side furthest from the membrane to receive anolyte therein.

4. The apparatus according to claim 3 wherein the spacer means further has flow passage means connecting the hollowed out central cavity and the receptacle means to permit anolyte to flow into and out of the hollowed out central cavity.

5. The apparatus according to claim 1 wherein the cooling plate further comprises a grooved out area adjacent the anode through which coolant is circulated.

6. The apparatus according to claim 1 wherein the cathode further comprises a planar backplate to which is fastened an active surface area material.

7. The apparatus according to claim 6 wherein the active surface area material further comprises a first layer of course mesh material adjacent the planar backplate and a second layer of fine mesh material atop the first layer.

8. The apparatus according to claim 7 wherein the cathode is separated from the membrane by a cathode spacer means, the cathode spacer means further surrounding the cathode active surface area material with a frame portion, the frame portion having a central hollowed out central cavity.

9. The apparatus according to claim 8 wherein the cathode spacer means frame portion has receptacle means above and beyond the hollowed out central cavity, the central cavity being open-topped on a side farthest from the membrane to receive catholyte therein.

10. The apparatus according to claim 9 wherein the cathode spacer means further has flow passage means connecting the hollowed out central cavity and the receptacle means to permit catholyte flow into and out of the hollowed out central cavity.

11. A method of operating a filter press membrane cell having an anolyte compartment and a catholyte compartment separated by an ion selectively permeable membrane comprising the steps of:

(a) circulating an anolyte solution of aqueous hypochlorous acid substantially free of chloride ions into and through the anolyte compartment;

(b) filling the catholyte compartment with a catholyte liquid; and (c) electrolyzing the anolyte solution to oxidize hypochlorous acid to chloric acid and cause $H_3O^+$ to migrate through the membrane producing an acidic catholyte and a chloric acid anolyte product.

12. The method according to claim 11 further comprising using deionized water as the catholyte and removing the acidified catholyte as hydrochloric acid from the catholyte compartment by the action of rising hydrogen gas bubbles.

* * * * *